United States Patent [19]

Lieberman

[11] Patent Number: 5,070,668

[45] Date of Patent: Dec. 10, 1991

[54] TEXTURED CONSTRUCTION MATERIAL AND METHOD OF FABRICATION

[76] Inventor: Ivan E. Lieberman, 500 Driftwood La., Destin, Fla. 32541

[21] Appl. No.: 442,419

[22] Filed: Nov. 24, 1989

Related U.S. Application Data

[63] Continuation of Ser. No. 128,407, Dec. 3, 1987, abandoned.

[51] Int. Cl.[5] ..... E04B 1/02

[52] U.S. Cl. ..... 52/309.9; 52/311; 52/446; 428/141; 428/285; 428/314.4; 264/225; 264/227; 264/255

[58] Field of Search ..... 428/141, 246, 285, 314.4, 428/319.1; 264/220, 225, 227, 250, 255; 52/309.8, 445, 446, 311, 314, 315, 612, 309.4, 309.7, 309.9

[56] References Cited

U.S. PATENT DOCUMENTS

| | | | |
|---|---|---|---|
| 2,728,702 | 12/1955 | Simon et al. | 52/309.9 |
| 2,762,739 | 9/1956 | Weiss | 428/141 |
| 3,232,017 | 2/1966 | Prusinski et al. | 52/309.9 |
| 3,264,165 | 8/1966 | Stickel | 52/309.15 |
| 3,922,413 | 11/1975 | Reineman | 264/250 |
| 4,050,978 | 9/1977 | Moore | 264/255 |
| 4,173,609 | 11/1979 | Engstrom | 264/46.4 |
| 4,224,773 | 9/1980 | Schworer | 52/309.8 |
| 4,510,726 | 4/1985 | MacDonald, Jr. | 52/309.8 |
| 4,536,145 | 8/1985 | Sawyer et al. | 425/289 |
| 4,774,794 | 10/1988 | Grieb | 52/309.8 |

*Primary Examiner*—Robert A. Dawson
*Assistant Examiner*—Allan R. Kuhns
*Attorney, Agent, or Firm*—James J. Brown

[57] ABSTRACT

A rigid, durable construction material is described along with a method for making the material. The material is particularly characterized by having a specific, textured surface which can resemble stucco and which can be reproduced exactly any desired number of times. The unique surface characteristics of the invention are obtained by preparing a reusable mold which is obtained by a reverse casting of a polymeric gel onto a cellular foam surface. The construction material of the invention is essentially a laminated, rigid backing having a polymeric surface coating with the desired texture obtained by casting a polymeric gel onto the reusable mold.

4 Claims, 1 Drawing Sheet

TEXTURED CONSTRUCTION MATERIAL AND METHOD OF FABRICATION

This application is a continuation of Ser. No. 07/128,407, filed Dec. 3, 1987, now abandoned.

SUMMARY OF THE INVENTION

The present invention relates to a rigid construction material having a reproducible textured surface which can for example, resemble stucco and to a method for making this material. More specifically, the present invention is directed to a rigid construction material having a cast, textured surface and a rigid backing which may, for example, consist of one or more layers of laminated material such as a core of rigid polymeric foam sandwiched between two layers of resin impregnated fiberglass. The invention also concerns a method by which the textured surface of the material can be reproduced identically any desired number of times.

BACKGROUND OF THE INVENTION

Various lightweight laminated construction materials are known in the art. It has, however, been difficult to provide a reproducible textured finish on such construction materials, especially when they are designed for exterior applications such as siding on houses. More particularly, the provision of a lightweight laminated sheet of construction material having a reproducible stucco finish has not heretofore been considered practical or feasible.

The advantages, however, of such a lightweight, laminated construction material having a reproducible stucco-like finish are relatively evident. Providing stucco finishes on the exterior of buildings or houses has heretofore been a relatively expensive operation requiring extensive manual labor. Further, attempts to provide prefabricated panels having the desired finish have often resulted in materials which were not uniform and which did not match.

Accordingly, there has remained a substantial need for a strong lightweight material, having a stucco-like finish which can be duplicated exactly any desired number of times.

It is therefore, an object of the present invention to provide a rigid construction material having a reproducible textured surface with the appearance of stucco. It is a further object of the present invention to provide such a construction material which is lightweight, durable, and suitable for exterior applications. Yet a further object of the present invention is to provide a glass core laminated construction material having a reproducible stucco finish and suitable for exterior applications which has both electrical and acoustic insulation properties as well as low linear thermal expansion. The attainment of these and other objectives through the practice of the present invention will, however, be more readily apparent from the description of the invention which follows.

DETAILED DESCRIPTION OF THE INVENTION

Figure 1:
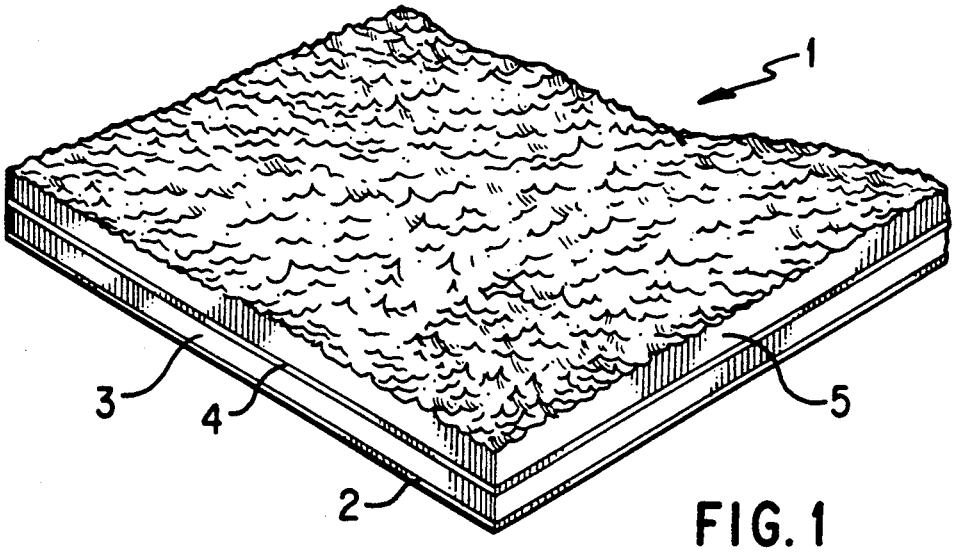
FIG. 1 is a perspective view of the textured glass core construction material of the present invention.

The present invention provides a rigid construction material having a reproducible textured surface and a method for fabricating this construction material. In accordance with the present invention, a male plug having the desired surface texture is first fabricated by casting and then curing a layer of curable polymeric gel onto a porous surface such as cellular polymeric foam so that the surface of the gel assumes the texture of the foam. Once this gel has cured, one or more layers of rigid backing are applied and adhered to the cured gel and the entire laminate consisting of backing and cured gel removed from the surface onto which it was initially cast. Removal of the cured gel from the porous foam surface is facilitated by the application of a suitable mold release composition prior to applying the uncured gel to the surface. The cast male plug having essentially the reverse texture of the porous foam from which it was prepared, is then used to prepare a female mold which has the irregular surface characteristics of the porous surface onto which the gel was initially cast.

The procedure for forming the female mold from the male plug is essentially the same as that used to fabricate the initial male plug. A suitable mold release composition, such as polyvinyl alcohol, is again applied to the textured surface of the male plug and a layer of curable polymeric gel then applied to this textured surface and cured so that it hardens to assume the reverse texture of the male plug. Once this initial layer of gel has cured, one or more layers of rigid backing are applied and adhered to the gel and the entire laminate separated from the male plug. The resulting female mold has essentially the same surface texture and characteristics as the original porous surface upon which the gel was initially cast when the male plug was formed. This female mold then provides a reusable implement for repeated duplicate castings of the final textured construction material of the present invention.

Preparation of the rigid textured construction material of the present invention using the female mold which has been prepared as heretofore described, generally follows the procedures used in the preparation of the male plug and female mold. A mold release composition is applied to the surface of the female mold and curable polymeric gel then applied and cured onto this surface. The cured polymeric gel is then reinforced by one or more layers of backing. The number and nature of the backing layers will depend on the strength, dimensions and weight that is desired for the final construction material. Advantageously, the backing material used in accordance with the present invention both for the final material as well as the mold and male plug will consist of a laminated sandwich of rigid foam material between two layers of fiberglass impregnated with suitable adhesive resin.

The product prepared in accordance with the present invention has a roughened, textured appearance on the cast side which closely resembles a stucco finish and which is exactly reproducible from the female mold. The material of the present invention further is lightweight and extremely strong so that it is suitable for both interior and exterior applications.

The invention will however, be more fully appreciated by having reference to the following detailed description of a preferred embodiment of the invention as well as the drawings provided herein.

Figure 2:
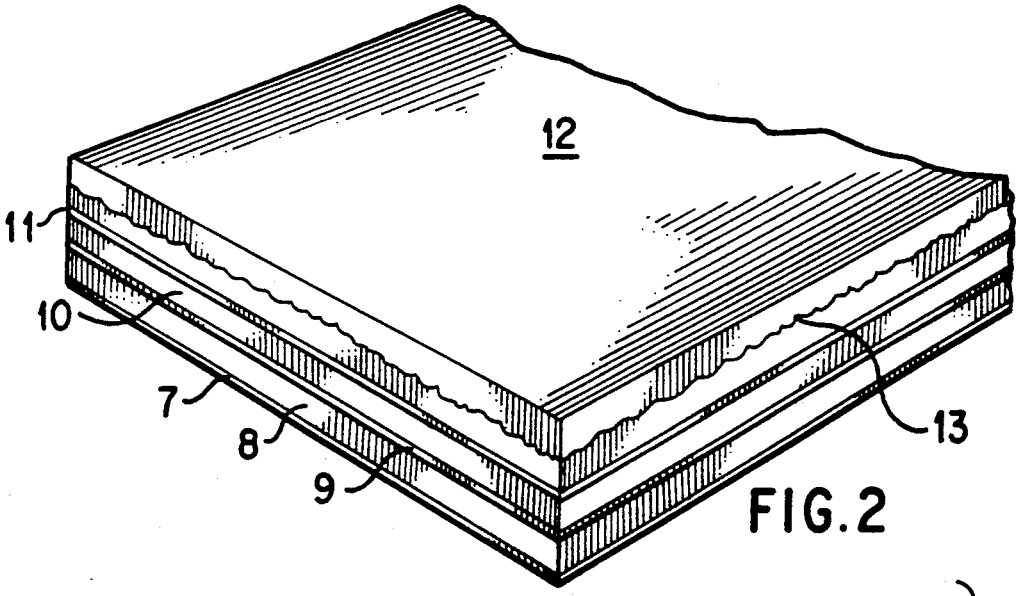
FIG. 2 is a perspective view of the mold from which the product of the present invention is cast.

Directing attention to FIG. 1 of the drawings, a preferred embodiment of the construction material of the present invention 1, is shown having a rigid backing consisting of a fiberglass mat 2, which is bonded to a core of cellular polyvinyl chloride foam material 3. An additional fiberglass mat 4 is sandwiched between the foam core 3, and the polymeric gel having the desired texture. This textured finish 5, is obtained by casting the gel onto the mold which is shown in FIG. 2 of the drawings. The textured mold shown in FIG. 2 of the drawings consist of fiberglass mats, 7, 9 and 11 which are alternatively layered with polyvinyl chloride foam cores 8 and 10 to form a rigid backing for the mold. The female gel surface 13 is cast on the layer of fiberglass to provide the female mold for preparing the molded textured surface 5, shown in FIG. 1 of the drawings.

Figure 3:
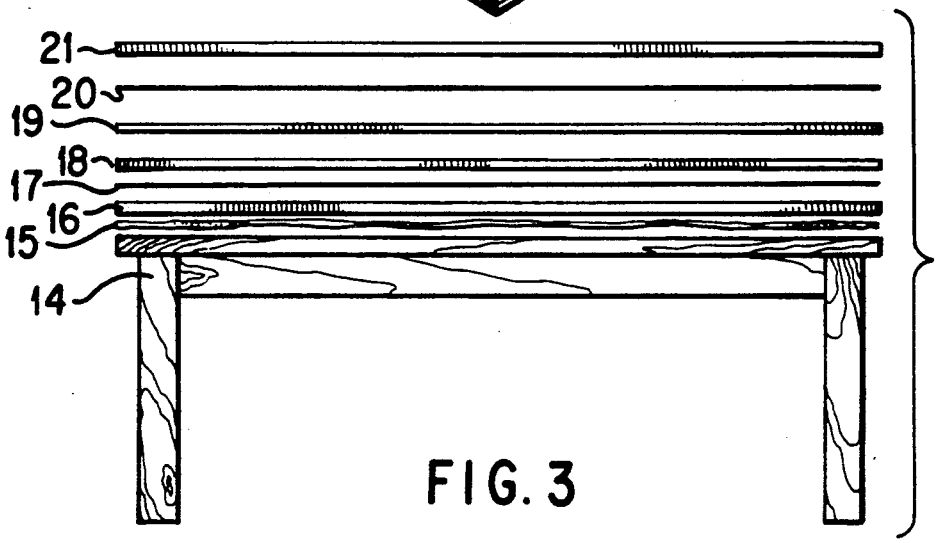
FIG. 3 is a side view illustrating preparation of the initial plug from which the mold of the present invention is cast.

FIG. 3 of the drawings illustrates the structure of the male plug which is used to prepare the female mold shown in FIG. 2 of the drawings. A rigid support surface 14, of plywood is provided with a layer of adhesive material 15 which adheres a layer of polyvinyl chloride foam material 16, to the support surface. Three to four layers of a release agent are provided at 17, and a layer of curable polyester gel 18 then applied to the dried release agent. Typically the mold release agent is polyvinyl alcohol or one of the commercially available agents such as "Partall" sold by Rexco Chemical Co. or "Mold Wiz" sold by Axel Plastics Research Laboratories, Inc. A layer of polyester resin impregnated fiberglass 19, is then applied to the cured gel, followed by a layer of polyvinyl chloride foam 21 to provide the necessary backing for the plug. Once the entire structure has cured sufficiently the two surfaces are separated. The resulting surface of the polyester gel has the roughened texture of stucco and provides the male plug for fabricating the female mold which can be used over and over to fabricate identical panels of material having the textured surface. The following exemplary description will however, illustrate more fully the techniques used to prepare the respective components of the invention illustrated in FIGS. 1, 2 and 3 of the drawings.

EXAMPLE

A six milimeter thick sheet of type 44 or 55, closed-cell polyvinyl chloride foam material having a density of 80 $Kg/m^3$ sold under the name Klegecell was adhered with adhesive to a flat table top. This polyvinyl chloride foam core was then coated with a layer of polyvinyl alcohol mold release composition which was allowed to dry and then recoated two more times to be certain that the mold release composition penetrated into the foam cells. Once the mold release composition layers were thoroughly dry, the surface was then lightly dusted by hand with a soft brush. The entire surface was then coated with a layer of curable polyester gel material 40 mills thick. The particular polyester gel used was a mixture of isothalic and n-penta glycol type polyesters in a styrene solvent marketed by Polygard, Inc., of Tampa, Fla. as a marine gel coat. This material was cured with 1.5 percent methyl-ethyl keytone peroxide initiator. The extent of cure was determined by measuring the Barcol hardness of the surface as it cured. When the gel surface attained the required degree of curing, it was then covered with a polyester resin and a three ounce fiberqlass mat and rolled out to, form a uniform bubble-free layer of chopped fiberglass roving saturated with polyester resin can also be used. While this layer of fiberglass and resin was still wet, a sheet of fire-retartant polyvinyl chloride core material was applied and rolled out to insure removal of air bubbles. The entire surface of the polyvinyl chloride core material was then coated with another layer of resin using 1.5 percent methal-ethyl keytone to initiate curing. Curing of the laminate occurred over a twenty-four hour period at a minimum temperature of 70° F. At the conclusion of this cure, the plug was ready to be removed from the initial polyvinyl chloride core material glued to the rigid wooden surface to which it was initially applied. Removal was performed by inserting a wedge between the gel-coat surface and the surface of the polyvinyl chloride material. The resulting gel surface had the texture and appearance of a stucco finish and provided a male plug from which a re-usable female mold was prepared.

The re-usable mold of the invention was prepared by placing the male plug with the cured gel surface face up on a supportive surface. The plug surface was carefully cleaned with a dilute solution of acetone and scrubbed with a stiff bristle brush. The dried plug surface was then coated with a layer of water insoluble liquid release composition such as Axel F-57. The surface of the mold release composition was hand-polished and an additional three layers of mold release composition applied to insure penetration into the porous surface of the male plug. A layer of polyester gel and cure initiator was then applied to this surface and allowed to cure for twenty-four hours at 70° F. The extent of curing was checked by means of a Barcol hardness tester. Four layers of resin impregnated fiberglass mat were then applied and cured to provide a strong backing for the gel coat surface of the mold. These layers of resin impregnated fiberqlass were coated with an additional layer of resin and cure initiator with a type 80 polyvinyl chloride foam core then applied and rolled out. An additional layer of resin and fiberglass mat were applied to the upper surface of the foam core material. This step was repeated six times with approximately one hour of curing allowed between the application of each layer of fiberglass and resin. The entire laminate was allowed to cure for a total of 24 hours. Finally, to insure complete and thorough rigidity of the mold, several more layers of backing each consisting of six layers of laminated fiberglass and resin applied to a layer of rigid polyvinyl chloride foam were applied to the surface and allowed to cure. The resulting mold which is illustrated in FIG. 2 of the drawings consisted of a composite of layers of cured fiberglass and resin interspersed with layers of polyvinyl foam material. The entire structure had a surface of molded gel which has a textured female surface for casting the stucco material of the invention.

Preparation of the actual textured construction material of the invention followed essentially the procedures already described for preparation of the plug and mold which are used to prepare the textured surface. Once the surface of the mold has been separated from the male plug, it was thoroughly cleaned and coated with a mold-release composition and a layer of curable polyester gel applied to the female mold surface. This was followed by a reinforcing backing consisting of a layer of cellular polyvinyl chloride foam core material sandwiched between two fiberglass mats, to provide the necessary structure and rigidity for the gel layer having the molded stucco appearance. Once the gel layer and backing layers acquired the necessary cure to be rigid, the entire structure was pried loose from the mold and had a textured surface resembling stucco. The mold was then used repeatedly to produce further identical panels having the same stucco appearance as the originally cast panel.

The texture and appearance of the construction material prepared in accordance with the invention can be varied by casting the original plug from a foam material having greater or less density and pore size. Similarly, the structural properties of the material can be varied by changing the backing used. The resulting product can be used conveniently in a variety of ways as decking, siding or interior of exterior panels. Color can be imparted by incorporating suitable pigments in the polymeric gel coat.

It is to be understood that it is within the contemplation and scope of the present invention to employ other and additional materials and to employ alternative, equivalent procedures from those described by way of example herein.

What is claimed is:

1. A rigid, non-cementitious laminated construction material having an irregular, textured surface comprising a cured, cast polymeric gel resembling stucco and further comprising alternating, continuously abutting layers of rigid, polymeric foam and resin impregnated glass fibers forming a rigid backing against said irregular textured surface, said material being made by the process comprising the steps of:

1. fabricating a rigid male plug having the desired surface texure by applying a layer of curable polymeric gel to a porous polymeric foam surface and applying one or more rigid layers of backing, and separating said porous surface from said gel layer and backing;
2. fabricating a female mold of said desired surface texture by applying sequentially to the male plug surface of step 1, a layer of curable polymeric gel, curing said gel layer, applying a rigid backing; curing said backing; and separating it and said cured gel from said male plug;
3. fabricating said rigid, laminated construction material by applying to the female mold surface prepared in step 2, a layer of polymeric gel, curing said gel and applying one or more backing layers while permitting each successive layer to cure and removing said laminated material from said mold.

2. A rigid, non-cementitious laminated construction material having an irregular textured surface resembling stucco and comprising a laminated backing consisting of one or more layers of rigid polymeric foam, each layer being continuously sandwiched between coextensive layers of resin impregnated glass fibers to form said rigid, laminated backing, said backing having directly formed thereon an irregular, textured surface of cured, cast polyermic gel resembling a stucco surface and obtained by casting said gel onto a female mold having the surface features of cellular polymeric foam.

3. A rigid, non-cementitious laminated construction material having a reproducible, textured surface and comprising a laminated backing consisting of one or more layers of rigid polymeric foam, each layer being continuously sandwiched between coextensive layers of resin impregnated glass fibers to form said rigid, laminated backing, said backing having directly formed thereon an irregular textured surface of cured, cast polymeric gel obtained by casting said gel onto a female mold having said reproducible, textured surface features, first curing said gel, then applying said backing and removing said layers of backing with said cast, textured surface from said mold.

4. The construction material of claim 3 wherein said polymeric gel is a polyester gel.

* * * * *